US005738636A

United States Patent [19]

Saringer et al.

[11] Patent Number: 5,738,636

[45] Date of Patent: Apr. 14, 1998

[54] CONTINUOUS PASSIVE MOTION DEVICES FOR JOINTS

[75] Inventors: John H. Saringer, Markham; Jeffrey J. Culhane, Pickering, both of Canada

[73] Assignee: Orthologic Corporation, Phoenix, Ariz.

[21] Appl. No.: 561,193

[22] Filed: Nov. 21, 1995

[51] Int. Cl.[6] ..... A61H 1/02

[52] U.S. Cl. ..... 601/5; 601/31; 601/32; 601/33; 601/29

[58] Field of Search ..... 601/5, 27, 29–33, 601/90, 92, 93, 98, 104; 602/16, 21, 24, 27

[56] References Cited

U.S. PATENT DOCUMENTS

| | | | |
|---|---|---|---|
| 4,089,330 | 5/1978 | Nicolosi et al. | 601/33 |
| 4,538,595 | 9/1985 | Hajianpour . | |
| 4,650,183 | 3/1987 | McIntyre . | |
| 5,067,479 | 11/1991 | Saringer et al. . | |
| 5,170,776 | 12/1992 | Pecheux . | |
| 5,352,185 | 10/1994 | Blauth et al. . | |
| 5,458,560 | 10/1995 | Kaiser et al. | 601/33 X |
| 5,503,619 | 4/1996 | Bonutti | 601/33 X |

FOREIGN PATENT DOCUMENTS

| | | | |
|---|---|---|---|
| 2661333 | 10/1991 | France . | |
| 90/02543 | 3/1990 | WIPO | 601/5 |

*Primary Examiner*—Danton D. DeMille
*Attorney, Agent, or Firm*—Dowell & Dowell PC; Lynn C. Schumacher

[57] ABSTRACT

The present invention provides continuous passive motion (CPM) devices for joints. An ankle CPM device includes a lower leg support attached at its lower end to a semi-circular track. An actuator slides along the track and can be locked in any desired position on the track. A shaft is pivotally connected at one end thereof to the actuator and a shoe is attached at the other end thereof. When the actuator is positioned at the bottom of the track the ankle joint of the patient undergoes inversion/eversion motion. When the motor housing is rotated 90° and positioned near the top of the track plantar/dorsi flexion movement is obtained. A combination of both types of joint movement are obtained for the actuator in intermediate positions. A wrist CPM device includes a brace for the forearm attached to a semi-circular track on which an actuator is mounted. A hand grip is mounted on a semi-circular bracket and a shaft extends between the actuator and a coupling slidably mounted on the semi-circular bracket. With the actuator positioned below the forearm, when the actuator pivots the shaft the wrist joint undergoes ulnar/radial deviation movement and when the motor is rotated 90° and positioned at the side of the arm extension/flexion movement of the wrist joint is obtained. Positioning the actuator in intermediate positions produces wrist movement which is a combination of extension/flexion and ulnar/radial deviation of the wrist joint.

33 Claims, 10 Drawing Sheets

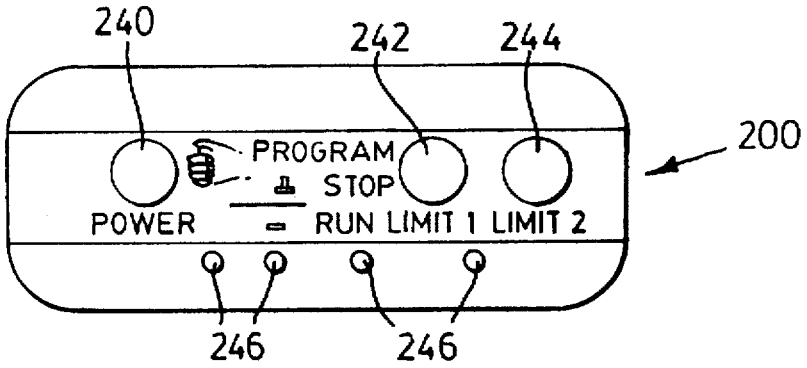

1) Depress Patient switch to run.
2) Release Patient switch (off) to stop unit or to program range of motion. (Red LED flash).
3) Use FWD/REV buttons on MultiLink actuator(s) to move arm to 1st range of motion limit.
4) Set limit by pressing LIMIT 1.
5) Use FWD/REV buttons on MultiLink actuator(s) to move arm to 2nd range of motion limit.
6) Set limit by pressing LIMIT 2

To change LIMIT 1 repeat steps 2), 3), 4) and 1).
To change LIMIT 2 repeat steps 2), 5), 6) and 1).

FIG.12

CONTINUOUS PASSIVE MOTION DEVICES FOR JOINTS

FIELD OF THE INVENTION

The present invention relates to continuous passive motion devices for therapeutic exercise of joints, and more particularly, the invention relates to continuous passive motion devices for wrist and ankle joint therapy.

BACKGROUND OF THE INVENTION

In recent years it has become evident that the rehabilitation and treatment of injured joints can be expedited by use of continuous passive motion (CPM) of the joint. Continuous passive motion entails inducing movement of certain limb portions without requiring muscle coordination or control by the patient. Numerous studies have shown the CPM of the different joints accelerates healing or recovery time, promotes healing and very importantly results in a fuller range of motion of the joint at the end of the course of therapy. Therefore, the rehabilitation of joints through continuous passive motion therapy has become an important method of treating joint injuries.

There are several known types of devices or machines for exercising wrist, ankle and elbow joints. U.S. Pat. No. 4,538,595 discloses several passive exercise devices for ankle, wrist and elbow joints. FIGS. 1 to 4 illustrate the wrist exercising embodiment comprising an actuator attached to a forearm brace assembly. An actuator arm extends from the actuator to a hand brace and in operation the hand undergoes extension/flexion movement. An embodiment for exercising the elbow joint is shown in FIGS. 18–19 and FIG. 24 shows a circumferential track used for adjusting the angle of the forearm and hand relative to the longitudinal axis of the upper arm during movement of the elbow joint. The ankle exercising device is shown in FIGS. 8 to 11 wherein the actuator is attached to the upper leg brace and the actuator rod is attached to the foot support to provide dorsal flexion/extension. The radial position of the foot relative to the longitudinal axis of the lower leg can be adjusted as shown in FIG. 11.

U.S. Pat. No. 4,650,183 discloses an exercise apparatus for foot and ankle joints. This device is used for exercise applications and to evaluate performance of the ankle joint. The device comprises a bench for the user to sit on during use, a pivotally mounted foot pedal and hydraulic cylinders attached to the foot pedal to provide resistance.

U.S. Pat. No. 5,067,479 discloses a CPM device for therapy of the wrist joint. The device comprises a telescopic rod slidably movable in a tubular shaft which is pivotally mounted to a base. One end of the shaft is pivotally attached to an eccentric transmission which includes a wheel driven by a motor supported by the base, the base being strapped to the top of the patient's wrist. The other end of the shaft is connected to a hand grip which is grasped by the patient. In operation the wheel is rotated causing the rod to telescope and pivot so that the hand undergoes movement at the wrist. The different types of wrist movement are obtained by adjusting the alignment of the motor housing assembly.

U.S. Pat. No. 5,170,776 discloses a device directed to passive articular mobilization of the foot. The device comprises a foot rest interconnected with various guide rods, screws, bearings, and a motor and a carriage.

U.S. Pat. No. 5,352,185 discloses an ankle exercising device including a frame with a support and a shoe attached thereto for receiving a user's lower leg and foot respectively.

This device requires two motors (8, 9 in FIG. 1) with one used to pivot part of the apparatus to give plantar flexion/dorsal extension and the other motor used to pivot another part of the device to produce supination/pronation of the foot relative to the lower leg.

It is very advantageous to provide a CPM device capable of moving a joint through its full range of physiologic movement. This capability would permit applications for the broadest possible range of indications and patients. Most human joints move through more than one axis while some, like the shoulder and hip, move through three. A major drawback to many of the known CPM devices is that they can only be set up to move a joint through one axis at a time. Utilizing more than one actuator in a CPM device to enable joint motion through more than one axis at a time becomes impractical due to bulk and weight restrictions.

Therefore, there is a need for a device for therapeutic exercising of joints which can be adapted for different types of joints and which provides a full range of joint motion through more than one axis at a time.

SUMMARY OF THE INVENTION

The present invention is directed to a device for providing continuous passive motion (CPM) of an anatomical joint. The device comprises a first support member for supporting a first limb portion on one side of a joint and a second support member for supporting a second limb portion on the other side of said joint. The CPM device is provided with an actuator and a shaft with distal and proximal end portions with the shaft being pivotally connected to the actuator at the proximal end portion of the shaft. The actuator pivots the shaft in sideways motion. The CPM device includes positioning means attached to the actuator so the actuator can be positioned circumferentially about the first limb portion with the pivotal connection constrained to move in an arcuate path about the joint. The second support member is adjustably attached at the distal end portion of the shaft so that the position of the second support member can be adjusted responsive to positioning the actuator.

The present invention provides a device for producing continuous passive motion of a wrist joint. The CPM device comprises an arm support member for supporting a forearm and means for securing the forearm in the arm support. An actuator is provided and a shaft with distal and proximal end portions is pivotally connected to the actuator at the proximal end portion. The actuator pivots the shaft in sideways motion and the device includes an arcuate track attached to the arm support member. The arcuate track is sized to extend at least partially around the forearm and the actuator is mounted on the arcuate track. The CPM device includes a hand support member including an arcuate ring with a bracket attached to the distal end portion of the shaft. The arcuate ring is adjustably mounted to the bracket so that the position of the hand support member can be adjusted responsive to positioning the actuator. The device includes second locking means for locking the arcuate ring to the bracket.

In another aspect of the invention them is provided a device for providing continuous passive motion of an ankle joint. The ankle CPM device comprises a frame, a leg support member attached to the frame for supporting a lower leg. The leg support member including means for securing the lower leg therein. The device includes an actuator and a shaft with distal and proximal end portions. The shaft is pivotally connected to the actuator at the proximal end portion. The actuator is operable to pivot the shaft in sideways motion. Them is provided an arcuate track attached to the leg support member which is sized to extend at least partially around the lower leg. The actuator is mounted on the arcuate track with the pivotal connection being constrained to move in an arcuate path about the ankle joint. The device includes first locking means for locking the actuator at a selected position on the arcuate track. The ankle CPM device includes a foot support member adjustably mounted at the distal end portion of the shaft so that the position of the foot support member can be adjusted responsive to positioning the actuator so the ankle can adopt a neutral position.

BRIEF DESCRIPTION OF THE DRAWINGS

The following is a description, by way of example only, of continuous passive motion devices constructed in accordance with the present invention, reference being had to the accompanying drawings, in which:

FIG. 12 is a view of a control panel of a controller forming part of the present invention;

DETAILED DESCRIPTION OF THE INVENTION

A) Wrist CPM Device

Figure 1A:
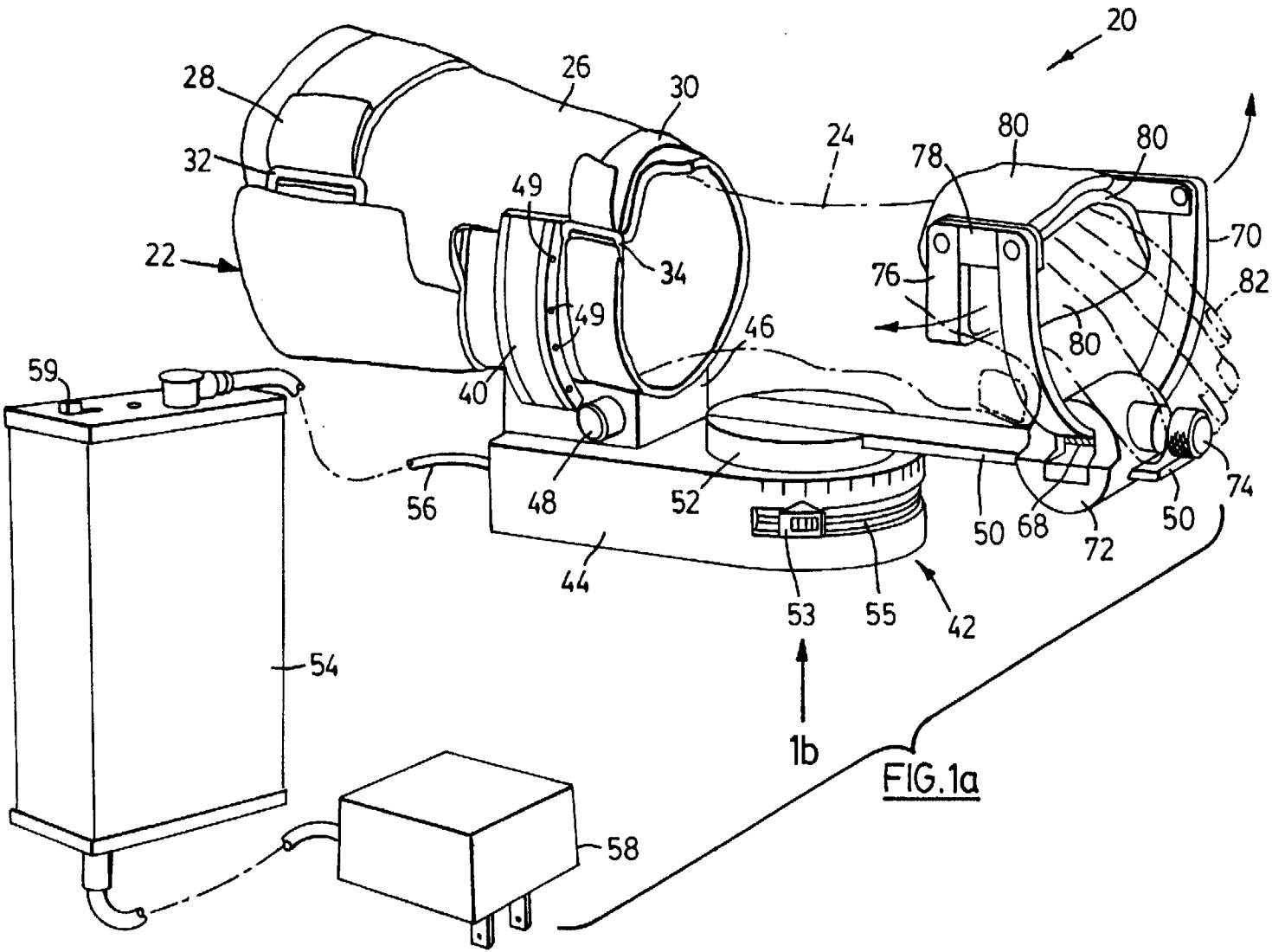
FIG. 1*a* is a perspective illustrational view of a continuous passive motion (CPM) device for exercising the wrist joint showing a hand and arm engaging the device, constructed in accordance with the present invention.

Referring to FIG. 1*a*, a continuous passive motion (CPM) device for exercising the wrist joint is shown generally at 20. Wrist CPM device 20 includes an arm support member 22 to receive a user's forearm shown in dashed line at 24. Forearm 24 defines a longitudinal axis. Support 22 includes a flexible sleeve 26 which is secured around the forearm by two hook and loop-type fastening straps 28 and 30 engaged with hooks 32 and 34 respectively. CPM wrist device 20 includes an arcuate track 40 with support 22 secured to the inside surface of track 40 by fasteners and standoffs (not shown). Arcuate track 40 is a semi-circular track and in FIG. 1*a* is shown describing about 200° arc of a circle of sufficiently large diameter to extend around the forearm of the patient.

Wrist CPM device 20 includes a motorized drive actuator 42 having a housing 44 and a slotted bracket 46 rigidly attached to housing 44. Bracket 46 is slidably mounted on track 40 so that the position of actuator 42 can be adjusted at any position on the track. Bracket 46 includes a position lock adjustment 48 for locking actuator 42 to track 40 in a desired position. Indentations 49 provide lock positions for locking track 40 relative to slotted bracket 46. The position of the actuator on track 40 is set by disengaging lock adjustment 48 and sliding actuator 42 to the desired position and then engaging lock 48.

CPM wrist device 20 includes a shaft 50 attached at its proximal end to a circular bracket 52 mounted on actuator 42 which in operation is pivoted with respect thereto by a motor (not shown) enclosed within housing 44. A controller/power supply 54 is connected to actuator 42 by power cord 56 and may include rechargeable batteries and/or an electrical power adapter 58. The motor within actuator housing 44 pivots shaft 50 side-to-side with respect to housing 44.

A hand support member comprises a semi-circular ring 70 attached to a bracket 72 which is secured on the distal end of shaft 50. Bracket 72 is slidably movable along shaft 50. Disposed between ring 70 and bracket 72 is a rubber pad or grommet 68 which acts as a flexible cushion between the ring and bracket to allow ring 70 to flex with respect to bracket 72. A locking screw 74 is used to lock ring 70 with respect to bracket 72 at a desired position so that it cannot slide through the bracket but it can be flexed or rocked back and forth due to the flexible pad 68 pressed between the ring and bracket. The hand support member includes a U-shaped cross member 76 attached at the end portions thereof to a pair of struts 78 which are connected to the end portions of semi-circular ring 70. Cross member 76 provides a hand grip and a loop and hook-type fastening strap 80 covers the cross member and secures the user's hand 82 onto the cross member.

Figure 1B:
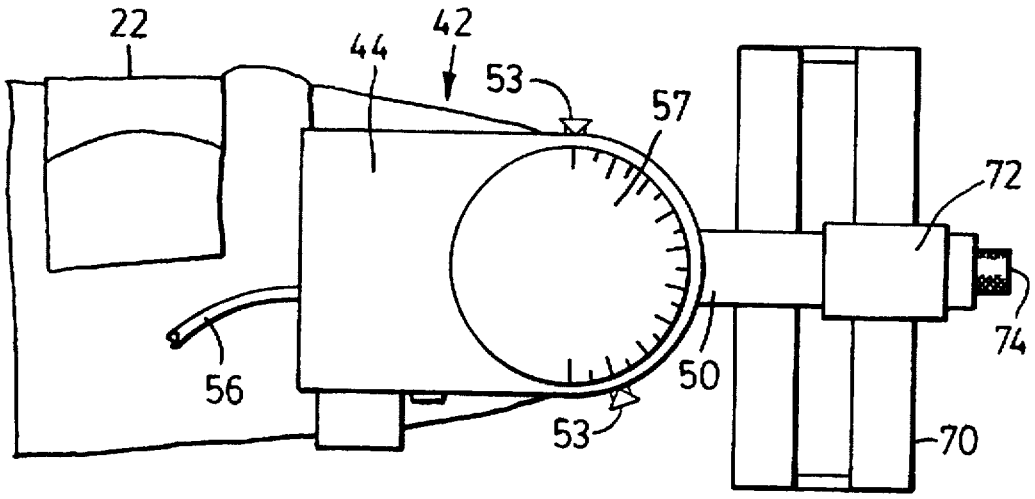
FIG. 1*b* is a view along arrow 1*b* of FIG. 1.

The range of pivotal motion of shaft 50 is set by adjusting two range of motion (ROM) slide switches 53 (both shown in FIG. 1*b*) located in slot 55 (FIG. 1*a*) operably coupled with a goniometer located within housing 44. Graduated markings 57 on the actuator are used as a reference for setting the position of the range of motion stop limit switches 53. These switches 53 determine the angular limits in which shaft 50 operates by limiting the pivotal movement of shaft 50.

Controller 54 contains control circuitry including a three position switch 59, position 1 corresponding to on/off; position 2 corresponding to 50% of full load; and position 3 corresponding to 100% of full load. Controller 54 contains the reverse-on-load technology to monitor the motor current which is disclosed in U.S. Pat. No. 4,716,889 and incorporated herein by reference. The actuator pivoting shaft 50 operates within preset values and if a preset value is exceeded, the motor changes direction to move shaft 50 in the opposite direction. If a patient resists the motion of shaft 50 the motor current increases and once the threshold current is exceeded the unit reverses direction.

Figure 2:
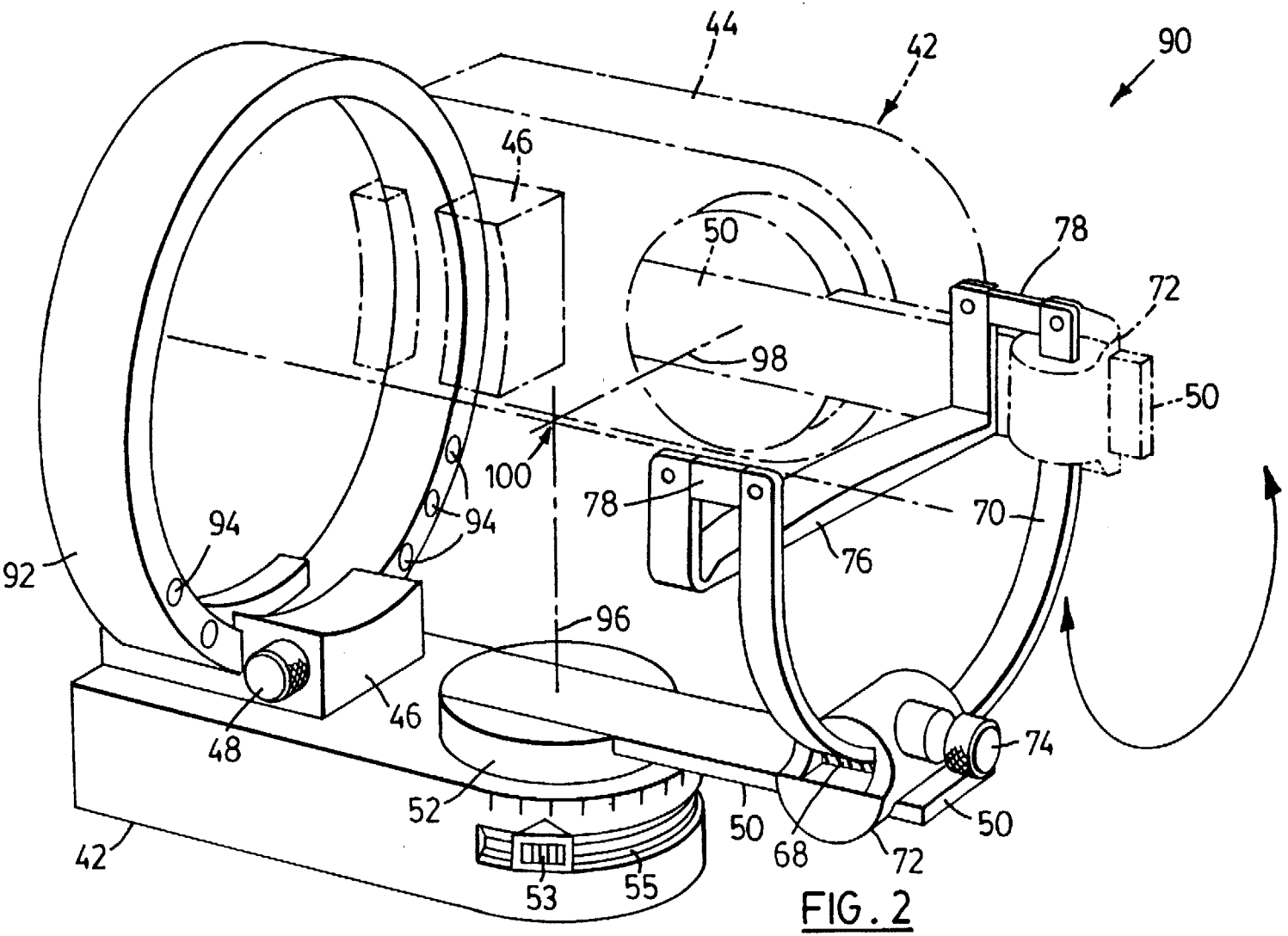
FIG. 2 is a perspective view of an another embodiment of a CPM device for the wrist absent the arm support showing the device in two orientations, the solid lines showing the device in an orientation to provide ulnar/radial deviation of the wrist joint, and the device shown in dashed line providing extension and flexion of the wrist joint.

FIG. 2 illustrates an alternative embodiment of a wrist CPM device 90 in which the arm support is not shown. CPM device 90 includes a track 92 which is circular in shape as compared to the semi-circular track 40 of the embodiment of FIG. 1*a*. Indentations 94 provide lock positions for locking track 92 relative to slotted bracket 46. When the motor pivots shaft 50 on actuator 42 shown in solid in FIG. 2 the drive bar pivots about axis 96, and for the actuator repositioned on track 90 shown in dashed line the drive bar pivots about axis 98. The distance that the distal end portion of shaft 50 pivots relative to the track 92 is adjusted or preset by the user or operator to accommodate the limitations of the wrist undergoing therapy so that either full range of extension, flexion, ulnar and radial deviation or a limited range for each motion is obtained as desired.

Human joints (articulations) can move in a single plane, perpendicular planes or in a combination of the planes. The range of motion (ROM) principle embodying the present invention allows a single axis drive to be positioned along a track, the center of which is concentric with the joint being manipulated and providing the joint with its full range of motion. The principle of operation of wrist CPM devices 20 and 90 are the same.

Referring to FIG. 2, arrow 100 indicates the virtual center of the CPM mechanism, which in use is coincident with the anatomical center of the wrist joint. The virtual center of CPM device 20 is also is coincident with the anatomical center of the wrist joint. The user straps his or her arm to support 22 (FIG. 1*a*) with the wrist joint aligned with the virtual center 100 of the CPM mechanism wherein the wrist joint is in registration with the pivot point or connection between shaft 50 and the rest of actuator 42. The relative positions of the wrist joint and track remain fixed while the position of actuator 42 is varied along track 92. FIG. 2 shows that the relative position of the wrist and virtual center 100 remains fixed as actuator 42 slides along track 92. Actuator 42 is shown in dashed line after being displaced about 90° along track 92. The pivotal connection of shaft 50 to actuator 42 is constrained to move in an arcuate path about the wrist joint in a plane substantially perpendicular to the longitudinal axis of the forearm with the wrist joint floating in the plane thereby decreasing tension and compression on the joint. In this way the joint alignment is maintained throughout the range of motion of the joint.

When actuator 42 is moved from the position producing deviation indicated by the solid line in FIG. 2 to the position producing flexion in the wrist, shown by the dashed lines in FIG. 2, it is moved 90° along track 92. However, because cross member 76 is fixed to bracket 72 it also rotates 90° through the same axis. Ring 70 is counter-rotated back to the neutral position where cross member 76 can be gripped by the user. This is accomplished by loosening knob 74 and rotating semi-circular ring 70 back to its original position. Therefore, when actuator 42 is moved along track 40, the hand support can be moved in the opposite direction to maintain the wrist joint in the neutral position.

The hand support members are constructed so that they can float with respect to the pivotal center of the actuator by the presence of rubber pad 68 between ring 70 and bracket 72.. This displacement accommodates the differences in the concentric pivoting motion of the actuator and the nonconcentric pivoting motion of the anatomic joint. This small amount of displacement prevents compression or tension being applied to the anatomical joint while the joint moves through the preset range of motion. Therefore, in use with the patient gripping the hand grip member as the joint undergoes the different types of movement the floating nature of the hand grip prevents unwanted stresses being placed on the joint. This floating hand support is very advantageous over known devices in which the hand grip is rigidly attached to the drive. The present invention allows anatomical alignment to be maintained when changing planes of motion.

Figure 3:
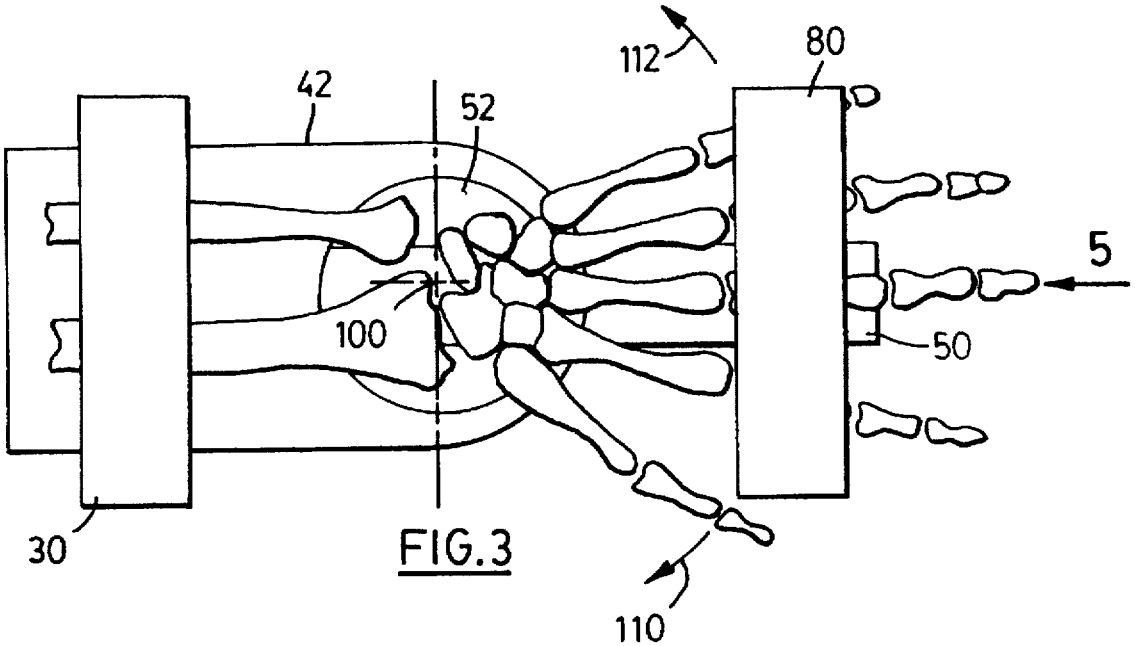
FIG. 3 is a top view of the wrist CPM device of FIG. 1 showing the relative positioning of the skeletal structure of the hand and wrist with the device in an orientation used to provide ulnar/radial deviation of the wrist joint.
Figure 4:
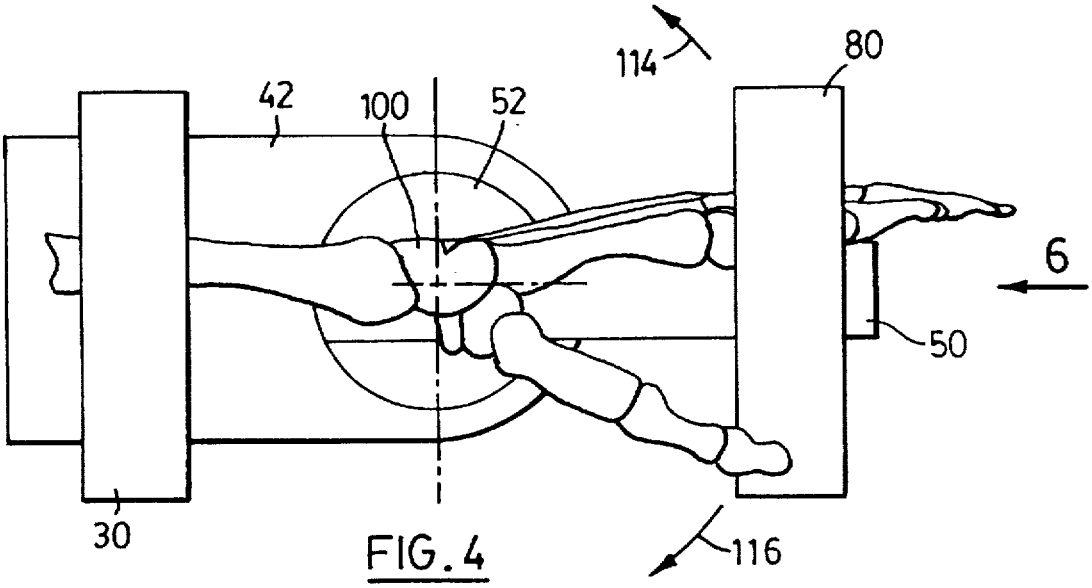
FIG. 4 is a side view of the wrist CPM device of FIG. 1 showing the relative positioning of the skeletal structure of the hand and wrist with the device in an orientation used to provide extension and flexion of the wrist joint.

FIGS. 3 and 4 show the relative positioning of the wrist joint with the wrist CPM mechanism 20 and 90 of FIG. 1 and 2, respectively, showing the anatomical center of the wrist joint coincident with the virtual center 100 of the CPM mechanism. The orientation shown in FIG. 3 corresponds to the orientation in FIG. 1 in which actuator 42 is positioned directly below the wrist and forearm and bracket 72 is positioned directly below the fingers gripping cross member 76. In this position when the motor pivots shaft 50, the wrist is forced to undergo radial deviation in direction of arrow 110 and ulnar deviation in direction of arrow 112 as shown. The position of the actuator 42 shown in dashed line in FIG. 2 provides extension and flexion motion of the wrist and hand with a user's forearm in the device, as shown in FIG. 4. In this position, when shaft 50 is pivoted, extension of the wrist is achieved in the direction of arrow 114 and flexion of the wrist is obtained in the direction of arrow 116.

Figure 8:
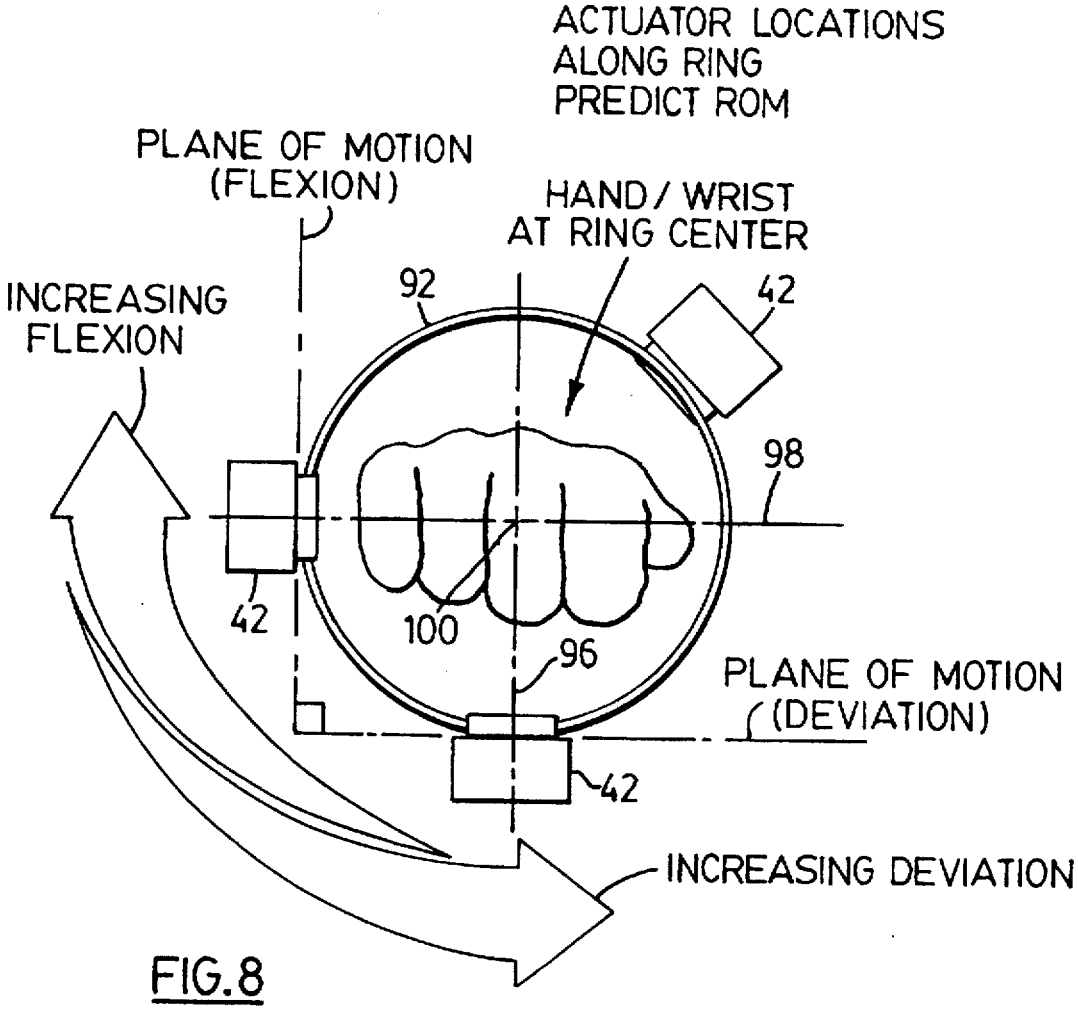
FIG. 8 illustrates the various orientations of the CPM wrist device with respect to a user's wrist showing the variation of wrist movement from flexion/extension to deviation depending on the orientation of the actuator on the circumferential track forming part of the present invention.
Figure 7:
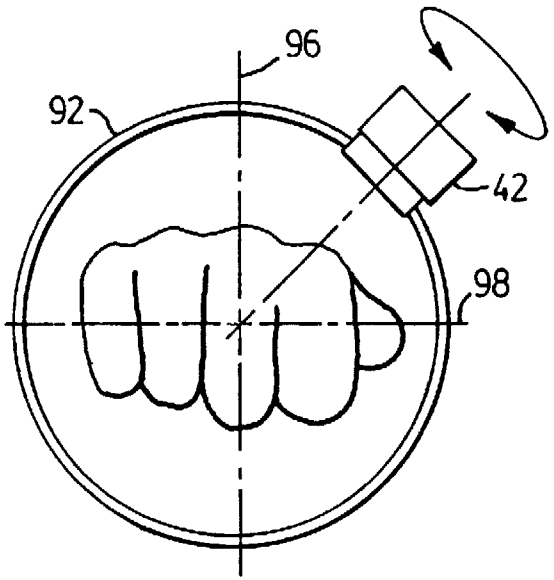
FIG. 7 is a view similar to FIGS. 5 and 6 showing the CPM wrist device in an orientation adapted to give a combination of extension/flexion and ulnar/radial deviation of the wrist joint.
Figure 6:
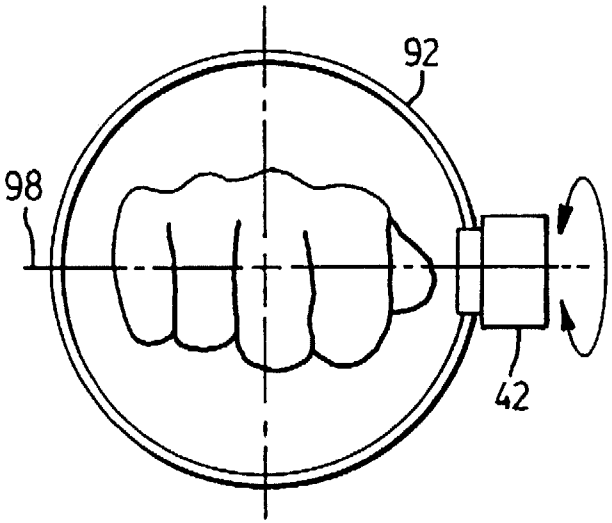
FIG. 6 is a front view taken in the direction of arrow 6 of FIG. 4 with flesh covering the skeletal structure and the hand gripping a hand grip.
Figure 5:
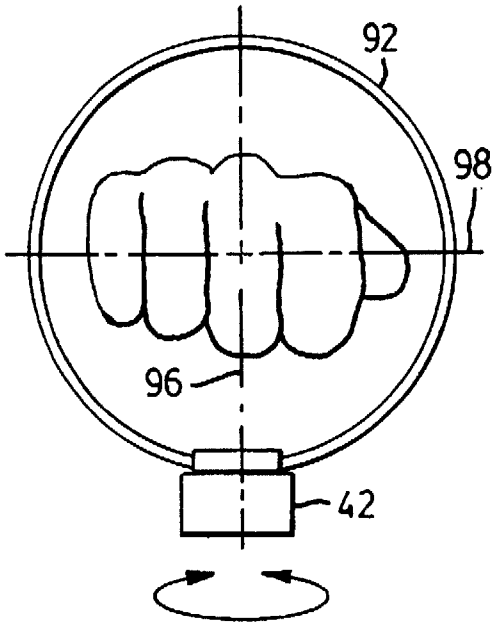
FIG. 5 is a front view taken in the direction of arrow 5 of FIG. 3 with flesh covering the skeletal structure and the hand gripping a hand grip.

FIGS. 5 and 6 are front views as seen from arrows 5 and 6 in FIGS. 3 and 4, respectively, showing the positioning of actuator 42 with respect to the wrist to give pure ulnar/radial deviation (FIG. 5) and pure extension/flexion motion (FIG. 6). FIG. 7 illustrates actuator 42 positioned at 45° between the planes of motion for pure flexion and deviation so that when shaft 50 is actuated the wrist undergoes combined flexion/extension and deviation movement. FIG. 8 summarizes the types of wrist movement corresponding to the various positions of actuator 42 on track 92.

The CPM wrist device of the present invention provides a number of advantages over known CPM devices. It allows for a full range of motion for flexion (0° to 90°), extension (0° to 90°), full ulnar and radial deviation of the wrist joint, and an adjustable range of each motion. The device provides for combined axis motion of the wrist by simply positioning the actuator anywhere in between the positions for each pure motion and no reassembly is required to change from flexion to deviation. This advantage is obtained by the actuator positioning mechanism comprising the arcuate track which maintains the wrist joint in registration with the pivot point of the actuator and actuator shaft as the actuator is repositioned around the limb and joint.

B) Ankle CPM Device

Figure 9:
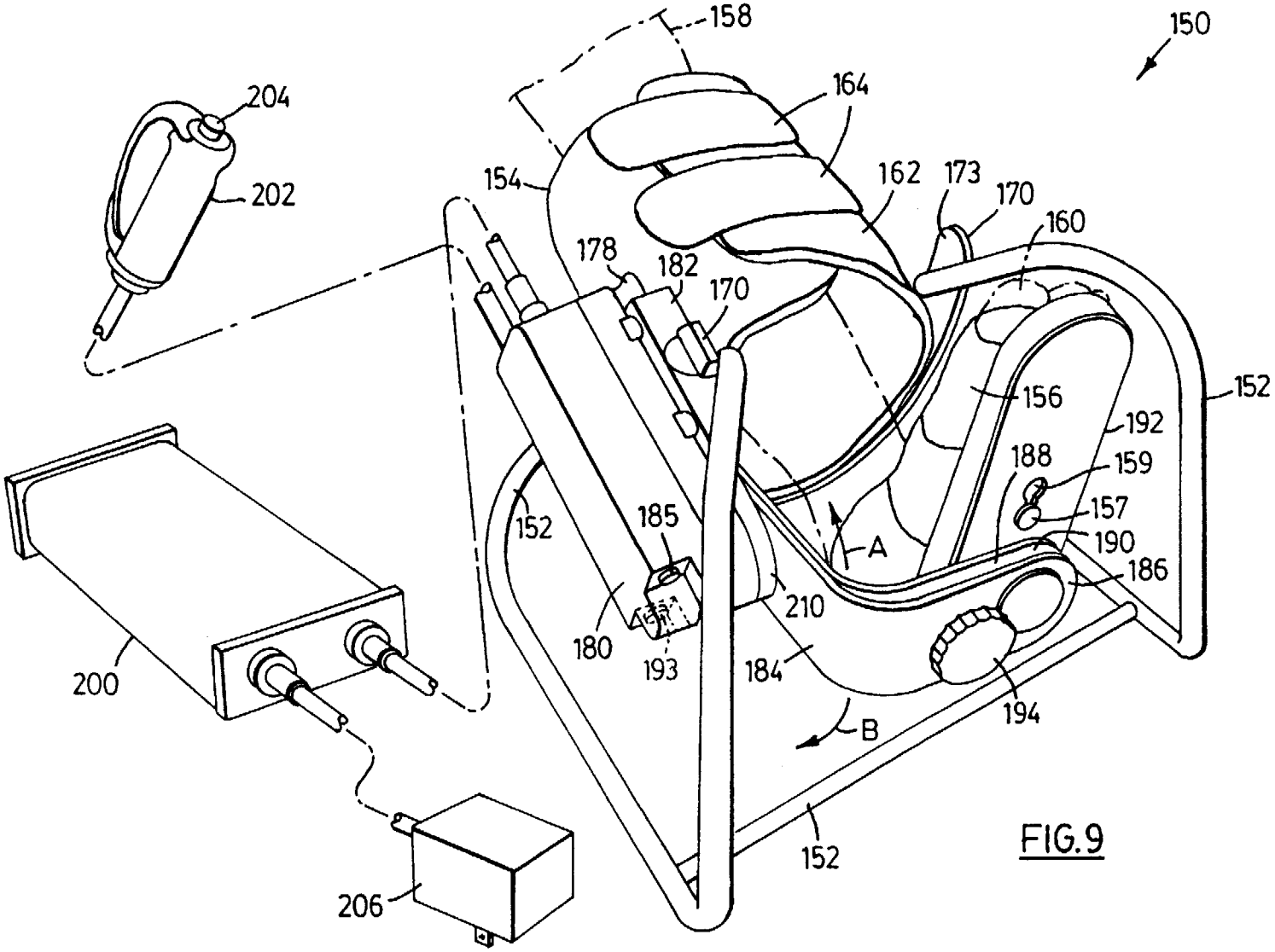
FIG. 9 is a perspective illustrative view of a CPM ankle device constructed in accordance with the present invention in an orientation used to provide plantarflexion/dorsiflexion range of ankle motion.
Figure 10:
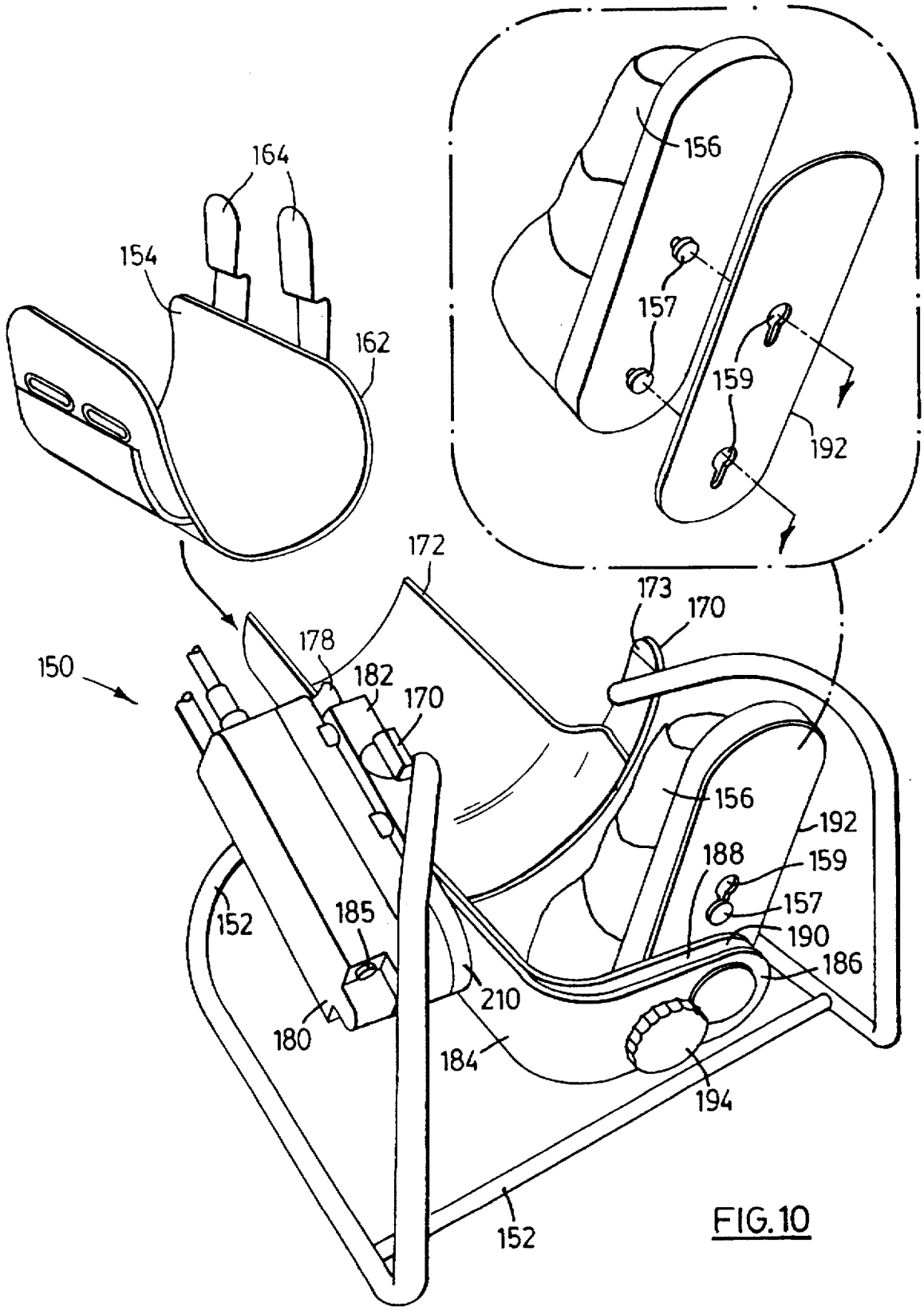
FIG. 10 is a perspective illustrative view of the CPM ankle device of FIG. 9 partially disassembled and showing details of the shoe assembly.
Figure 11:
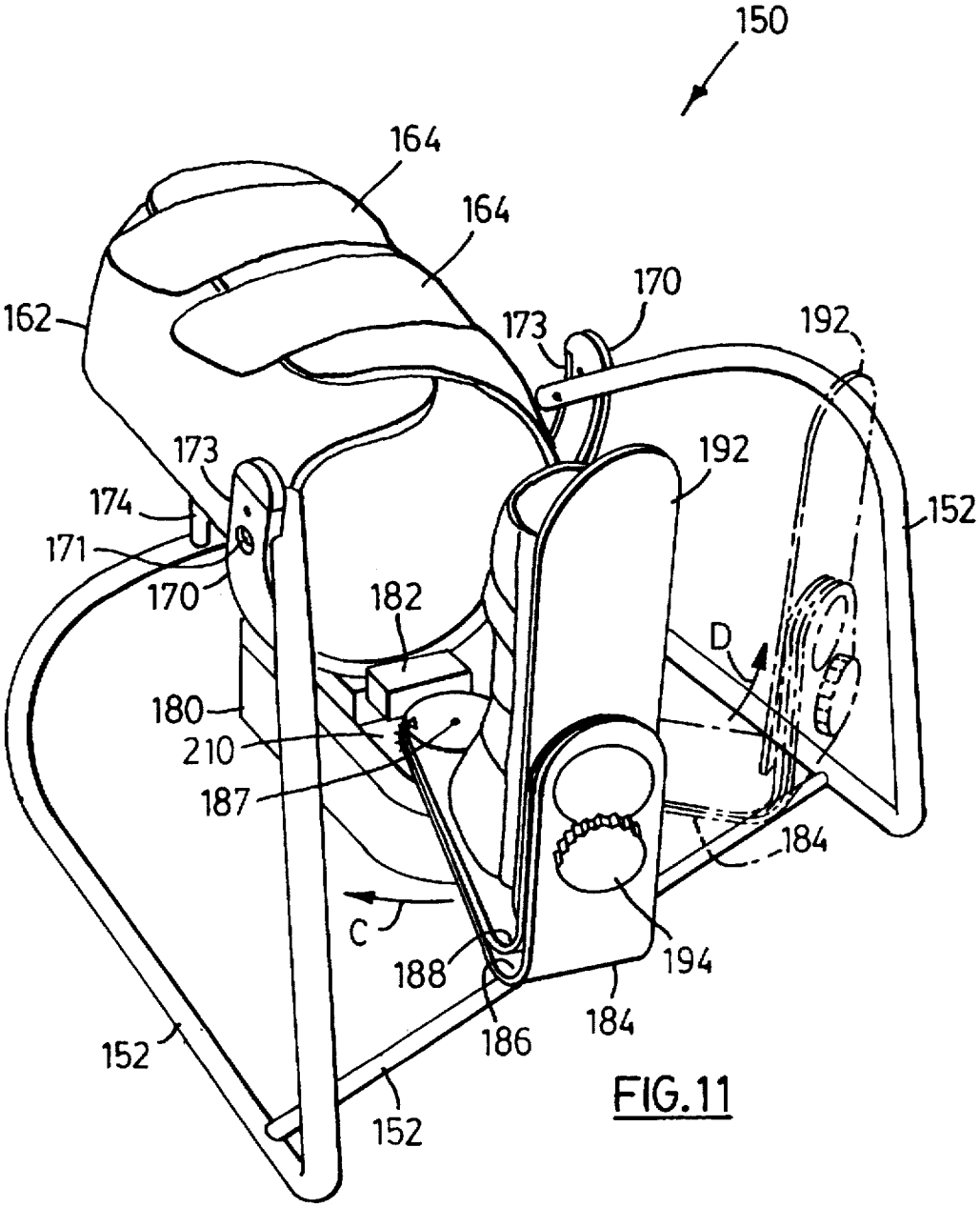
FIG. 11 is a perspective view of a CPM ankle device constructed in accordance with the present invention in an orientation used to provide inversion/eversion range of motion of the ankle joint.

Referring now to FIGS. 9 to 11, a CPM device for passive motion of an ankle joint is shown generally at 150. Ankle CPM device 150 includes a frame 152 to which a lower leg harness 154 and a shoe 156 are attached for receiving a user's lower leg 158 and foot 160 shown in dashed line. Harness 154 comprises a flexible sleeve 162 with a pair of hook and loop-type fastening straps 164 for securing lower leg 158 in the harness. An arcuate track 170 which is preferably semi-circular, is attached to frame 152 at the upper end portions shown at 171 in FIG. 11. A contoured leg support 172, seen only in FIG. 10, is attached at one end thereof to the inner concave surface of track 170 and at the other end to the top of a vertical support strut 174, shown in FIG. 11. This strut provides support to leg support 172 and the lower leg 158 when secured in the harness 162.

An actuator 180 is provided with a slotted bracket 182 which is slidably mounted on track 170. With reference to FIG. 9 and 10, a spring loaded lever handle 178 engages indentations (not shown) disposed along surface 173 of track 170 every 10 degrees from 0° to 90° to lock actuator 180 in the desired position on the track. Actuator 180 houses a motor (not shown) pivotally connected to a shaft 184 with the pivotal connection shown at 187 in FIG. 11 only. When the actuator is operating the motor pivots the L-shaped shaft in the direction of arrows A and B. Actuator 180 includes two forward/reverse buttons 185 and 187 respectively for the motor, one located on each side of the actuator. In FIG. 9, depressing button 185 drives shaft 184 upward in direction of arrow A and depressing button 193 drives shaft 184 downwardly in direction of arrow B. A goniometer 210 is mounted on actuator 180 to provide an angular reference used to set and monitor the range of pivotal motion of shaft 184 with respect to the actuator.

The L-shaped shaft 184 comprises two leaves 186 and 188 with a "TEFLON" disc 190 interposed between the leaves. Shoe 156 includes a sole or footplate 192 pivotally attached to leaves 186 and 188. A locking knob 194 is used to tighten leaves 186 and 188 together. By loosening knob 194 the angle of shoe 156 with respect to shaft 184 can be changed and tightening knob 194 locks the shoe at the selected angle. Referring to the partial enlarged view in FIG. 10, shoe 156 is installed by aligning posts 157 with holes 159 and applying pressure to register the posts in the keyholes and then sliding the shoe relative to the footplate to engage the posts.

Actuator 180 is electrically connected to a controller 200 (FIG. 9) provided with a manually operated wand 202. Patient activated wand 202 contains a thumb activated button 204 for turning the unit on and off. Controller 200 may be battery operated or an adapter 206 can be used for providing power from a wall socket. Controller 200 contains the control electronics and a rechargeable battery (not shown).

FIG. 12 shows the front panel of a preferred embodiment of controller 200 provided with an on/off button 240, a first limit switch 242, a second limit switch 244 and light emitting diode indicators 246 associated with each. The user depresses switch 204 to provide the ankle movement. Switch 204 is released to stop actuator 180 or to program the range of motion. Referring to FIGS. 9 and 12, to set the range of motion for actuator 180 requires the programming of only two points, the beginning point of the range of motion (limit 1) and the end point of the range of motion (limit 2). The first position or limit is set by depressing button 185 until the shaft reaches the first limit 1 and then releasing button 185 and pressing limit button 242. The second limit is set by depressing button 187 until shaft 184 reaches the second limit 2 and then releasing button 187 and pressing limit button 244. The controller stores these two ROM limits which are manually set by the patient or therapist. Once the limit values are programmed and stored arm 184 travels between the two preselected limits. Controller 200 utilizes the reverse-on-load technology described above.

In operation the user secures his or her foot and leg into ankle CPM device 150. Referring to FIG. 9, with actuator 180 mounted on track 170 at an upper end thereof on either the right or left side, once the power is turned on, shaft 184 and shoe 156 pivot up and down in the direction of arrows A and B respectively. This provides a plantarflexion/dorsiflexion range of motion. Referring specifically to FIG. 11, for subtalar joint complex mobility, actuator 180 is located at the bottom of track 170. This provides an inversion/eversion range of ankle motion as represented by arrows C and D. The pivotal connection 187 of shaft 184 to actuator 180 is constrained to move in an arcuate path about the ankle joint in a plane substantially perpendicular to the longitudinal axis of the lower leg. In this way the joint alignment is maintained throughout the range of motion of the joint.

The range of motion of the CPM ankle device is dependent on the position of actuator 180 along the arcuate track 170 and the range of motion operating limits set with motion controller 200 described previously. In order to change the range of motion of CPM ankle device 150 from flexion to inversion/eversion, the user depresses lever handle 178 (FIG. 9) on actuator 180 and slides the actuator along track 170 to the desired position. Lever handle 178 is released thereby locking the actuator in this position. With the actuator assembly in the selected position footplate 192 and shoe 156 are rotated to the vertical orientation and knob 194 is tightened. Ankle joint movement comprising a combination of inversion/eversion and flexion/extension is obtained by positioning actuator 180 at an angle between 0° and 90° and pivoting the foot plate to the vertical position and locking the shoe in the vertical position.

Figure 13A:
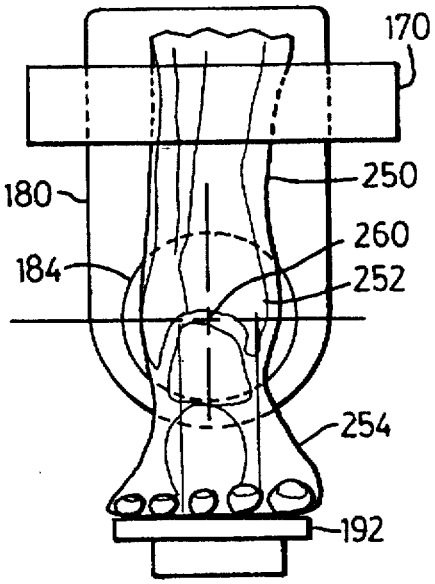
FIG. 13*a* is a diagrammatic view of a user's leg in the ankle CPM device of FIG. 9 showing the skeletal structure of the foot, ankle and lower leg with respect to the device in an orientation used to provide inversion/eversion range of motion of the ankle joint.
Figure 13B:
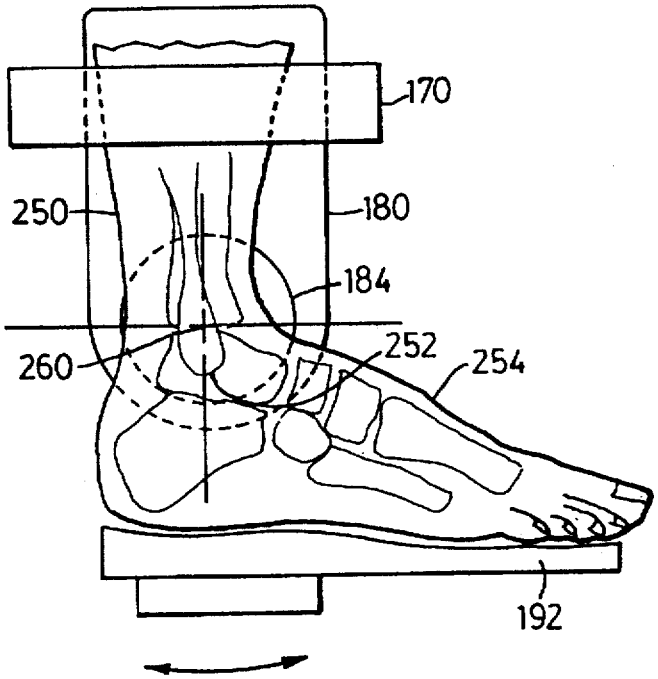
FIG. 13*b* is a diagrammatic view similar to FIG. 12*a* showing the skeletal structure of the foot, ankle and lower leg with respect to the device in an orientation used to provide plantarflexion/dorsiflexion range of ankle motion.

FIGS. 13*a* and 13*b* illustrate the positioning of a leg of a patient showing the relative positioning of the lower leg 250, ankle joint 252 and foot 254 with respect to actuator 180. The positioning shown in FIG. 13*a*, corresponding to FIG. 11 provides inversion/eversion range of motion of the ankle joint and shows the virtual center 260 of the ankle CPM device coincident with ankle joint 252 in which the ankle joint is in registration with the pivotal connection between shaft 184 and actuator 180. Movement of actuator 180 to the position shown in FIG. 13*b* to give plantarflexion/dorsiflexion range of ankle motion shows the ankle joint is still in registration with the pivot point.

Figure 14:
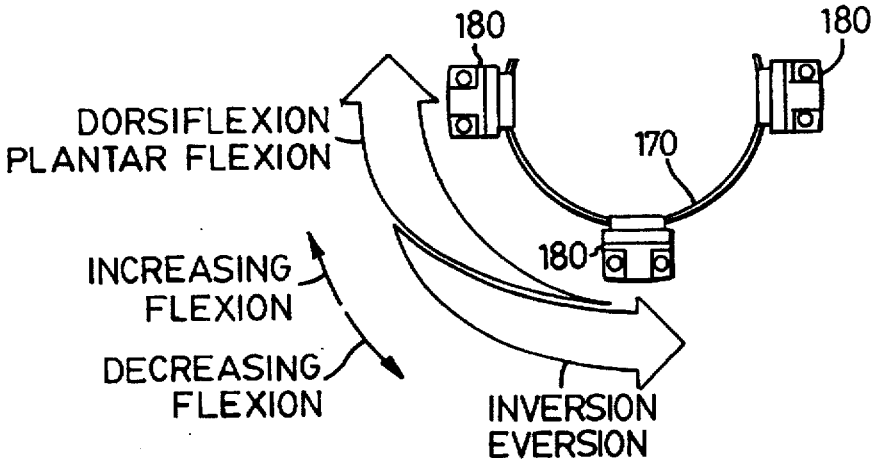
FIG. 14 shows the type of ankle movement obtained for different positions of an actuator mounted on an arcuate track according to the present invention.

FIG. 14 illustrates the transition from one type of ankle movement to the other as a function of the position of actuator 180 on track 170. Therefore, similar to the wrist CPM devices disclosed above, the actuator slidably mounted on the semi-circular track maintains the pivot point circumferentially disposed about the ankle joint with different circumferential positions giving different combinations of ankle joint movement.

Those skilled in the art will appreciate that the devices disclosed herein can be adapted for other joints in which passive motion in more than one plane is beneficial. Thus, while the CPM devices for wrist and ankle joints have been described and illustrated with respect to the preferred and alternative embodiments, it is intended that the scope of the invention be defined by all of the embodiments within the ambit of the claims and their equivalents.

Therefore what is claimed is:

1. A device for providing continuous passive motion of an anatomical joint, comprising:

a first support member adapted to engage a first limb portion on one side of a joint;

a second support member adapted to engage a second limb portion on another side of said joint;

an actuator and a shaft with distal and proximal end portions, said shaft being pivotally movably by said actuator at said proximal end portion, said actuator being operable to pivot said shaft in sideways motion;

positioning means attached to said first support member and adapted to extend at least partially about the first limb portion, said actuator being adjustably mounted to said positioning means so that said actuator can be moved in an arcuate path relative to said joint, and locking means for releasibly locking said actuator in a selected position to said positioning means; and said second support member being adjustably attached at the distal end portion of said shaft so that a position of attachment of said second support member to said shaft can be adjusted responsive to the selected position of said actuator relative to the limb.

2. The continuous passive motion device according to claim 1 wherein said positioning means is an arcuate track attached to said first support member, said arcuate track being sized to extend at least partially around said first limb portion, and said actuator being slidably mounted on said arcuate track, wherein when a user's limb is in said device said actuator is moved circumferentially about said first limb portion said pivotal connection moves in a plane that is substantially perpendicular to a longitudinal axis of said first limb portion and passes through said joint.

3. The continuous passive motion device according to claim 2 wherein said first support member includes an arm support for supporting a forearm and means for securing said forearm in said arm support, said second support member includes a hand grip adjustably mounted at the distal end portion of said shaft.

4. The continuous passive motion device according to claim 3 wherein said actuator is slidably movable on said arcuate track, first locking means for locking said actuator at a selected position on said arcuate track, said hand grip including an arcuate ring, a bracket attached to said distal end portion of said shaft, said arcuate ring being slidably mounted to said bracket, and second locking means for locking said arcuate ring to the bracket.

5. The continuous passive motion device according to claim 4 wherein said bracket comprises resilient biasing means, said ring engaged against said resilient biasing means so the ring can flex with respect to the bracket.

6. The continuous passive motion device according to claim 5 comprising a control means connected to said actuator for controlling the movement of said shaft.

7. The continuous passive motion device according to claim 6 comprising first and second limit switches connected to said actuator, first limit switch limits pivotal displacement of said shaft in one direction and said second limit switch limits pivotal displacement of said shaft in an opposite direction.

8. The continuous passive motion device according to claim 7 wherein said actuator comprises a housing, a goniometer mounted on said housing to indicate angular displacement of said shaft, said first and second limit switches being slidably movable and positioned with respect to said goniometer.

9. The continuous passive motion device according to claim 8 wherein said control means includes load monitoring means for monitoring the load on said actuator during movement thereof, the load monitoring means reverses the direction of movement of said shaft when said load exceeds an effective load.

10. The continuous passive motion device according to claim 9 wherein said arcuate track has a semi-circular shape and said arcuate ring has a semicircular shape.

11. The continuous passive motion device according to claim 9 wherein said arcuate track is circular-shaped and said arcuate ring has a semi-circular shape.

12. The continuous passive motion device according to claim 2 wherein said first support member comprises a frame and a leg support attached thereto for supporting a lower leg, means for securing said lower leg in the leg support, said second support member includes a foot support pivotally mounted at said distal end portion of said shaft, and in use movement of said shaft affects movement of the ankle joint.

13. The continuous passive motion device according to claim 12 wherein said actuator is slidably movable on said arcuate track, locking means for locking the actuator on said arcuate track anywhere along said arcuate track, said foot support comprising a shoe pivotally mounted at said distal end portion of the shaft.

14. The continuous passive motion device according to claim 13 comprising a control means connected to said actuator for controlling the movement of said shaft.

15. The continuous passive motion device according to claim 14 wherein said control means includes first and second limit switches, first limit switch limits pivotal displacement of said shaft in one direction and said second limit switch limits pivotal displacement of said shaft in an opposite direction, first and second limit positions being preselected and stored in said control means.

16. The continuous passive motion device according to claim 15 wherein said control means includes load monitoring means for monitoring the load on said actuator during movement thereof, the load monitoring means reverses the direction of movement of said shaft when said load exceeds a threshold load.

17. The continuous passive motion device according to claim 15 wherein said actuator comprises a housing, a goniometer mounted on said housing to indicate angular displacement of said shaft.

18. The continuous passive motion device according to claim 15 wherein said arcuate track is a semi-circular track.

19. A device for providing continuous passive motion of a wrist joint, comprising:

an arm support member for supporting a forearm and means for securing said forearm in said arm support member;

an actuator and a shaft with distal and proximal end portions, said shaft being pivotally connected to said actuator at said proximal end portion, said actuator being operable to pivot said shaft in sideways motion, an arcuate track attached to said arm support member, said arcuate track being sized to extend at least partially around said forearm, said actuator being adjustably mounted on said arcuate track for movement in an arcuate path about said wrist joint, first locking means for releasibly locking said actuator in a preselected position to said arcuate track; and a hand support member including an arcuate ring, a bracket attached to said distal end portion of said shaft, said arcuate ring being adjustably mounted to said bracket so that the position of the hand support member can be adjusted responsive to positioning the actuator in order to maintain said wrist joint in a neutral position, and second locking means for locking said arcuate ring to the bracket, said bracket including resilient biasing means, said ring engaged against said resilient biasing means so the ring can flex with respect to the bracket.

20. The continuous passive motion device according to claim 19 wherein when a user's forearm is in said device and said actuator is moved circumferentially about said forearm said pivotal connection moves in a plane that is substantially perpendicular to a longitudinal axis of said forearm and passes through said wrist joint.

21. The continuous passive motion wrist device according to claim 20 comprising a control means connected to said actuator for controlling the movement of said shaft.

22. The continuous passive motion wrist device according to claim 21 comprising first and second limit switches connected to said actuator, first limit switch limits pivotal displacement of said shaft in one direction and said second limit switch limits pivotal displacement of said shaft in an opposite direction.

23. The continuous passive motion wrist device according to claim 22 wherein said actuator comprises a housing, a goniometer mounted on said housing to indicate angular displacement of said shaft, said first and second limit switches being slidably movable and positioned with reference to said goniometer.

24. The continuous passive motion wrist device according to claim 23 wherein said control means includes load monitoring means for monitoring the load on said actuator during movement thereof, the load monitoring means reverses the direction of movement of said shaft when said load exceeds an effective load.

25. The continuous passive motion wrist device according to claim 24 wherein said arcuate track is a semi-circular track.

26. The continuous passive motion wrist device according to claim 24 wherein said arcuate track is a circular track.

27. A device for providing continuous passive motion of an ankle joint, comprising:

a frame, a leg support member attached to said frame for supporting a lower leg, said leg support member including means for securing said lower leg therein, said lower leg defining a longitudinal axis;

an actuator and a shaft with distal and proximal end portions, said shaft being pivotally connected to said actuator at said proximal end portion, said actuator being operable to pivot said shaft in sideways motion, an arcuate track attached to said leg support member, said arcuate track being sized to extend at least partially around said lower leg, said actuator being mounted on said arcuate track for circumferential movement about said lower leg, and in use movement of said shaft affects movement of said ankle joint, locking means for locking said actuator at a selected position on said arcuate track; and a foot support member pivotally mounted at the distal end portion of said shaft adapted to receive a foot of a user.

28. The continuous passive motion device according to claim 27 wherein when a user's leg is in said continuous passive motion device and said actuator is moved circumferentially about said leg said pivotal connection moves in a plane that is substantially perpendicular to said longitudinal axis and passes through said ankle joint.

29. The continuous passive motion device according to claim 28 comprising a control means connected to said actuator for controlling the movement of said shaft.

30. The continuous passive motion device according to claim 28 wherein said control means includes first and second limit switches, first limit switch limits pivotal displacement of said shaft in one direction and said second limit switch limits pivotal displacement of said shaft in an opposite direction, first and second limit positions being preselected and stored in said control means.

31. The continuous passive motion device according to claim 30 wherein said control means includes load monitoring means for monitoring the load on said actuator during movement thereof, the load monitoring means reverses the direction of movement of said shaft when said load exceeds a threshold load.

32. The continuous passive motion device according to claim 30 wherein said actuator comprises a housing, a goniometer mounted on said housing to indicate angular displacement of said shaft.

33. The continuous passive motion ankle device according to claim 30 wherein said arcuate track is a semi-circular track, said foot support member is a shoe.

* * * * *

UNITED STATES PATENT AND TRADEMARK OFFICE

CERTIFICATE OF CORRECTION

PATENT NO. : 5,738,636

DATED : April 14, 1998

INVENTOR(S) : John H. Saringer, et al.

It is certified that error appears in the above-identified patent and that said Letters Patent is hereby corrected as shown below:

Claim 1, line 9, "movably" should read --movable--;

Claim 2, line 31, before "said actuator is moved circumferentially....", --and-- should be inserted.

Signed and Sealed this

Eighteenth Day of August, 1998

Bruce Lehman

*Attest:*

BRUCE LEHMAN

*Attesting Officer*

*Commissioner of Patents and Trademarks*